United States Patent [19]

Schwartz et al.

[11] Patent Number: 5,056,200

[45] Date of Patent: Oct. 15, 1991

[54] APPARATUS FOR MAKING NOVEL TEXTURED YARN

[75] Inventors: Nathan G. Schwartz, Bryn Mawr, Pa.; Harry A. Prosceno, Wilmington, Del.

[73] Assignee: Textured Yarn Company, Inc., Kennett Square, Pa.

[21] Appl. No.: 619,320

[22] Filed: Nov. 28, 1990

Related U.S. Application Data

[62] Division of Ser. No. 462,654, Jan. 9, 1990, Pat. No. 4,993,218.

[51] Int. Cl.[5] ..... D02G 1/20; D02G 3/22

[52] U.S. Cl. ..... 28/258; 28/252; 57/409

[58] Field of Search ..... 28/252, 258, 262, 263, 28/265, 266, 281; 57/409

[56] References Cited

U.S. PATENT DOCUMENTS

| | | | |
|---|---|---|---|
| 2,985,995 | 5/1961 | Bunting et al. | 57/140 |
| 3,455,096 | 7/1969 | Whitley | 57/34 |
| 3,460,336 | 8/1969 | Collingwood et al. | 57/140 |
| 3,534,540 | 10/1970 | Collingwood et al. | 57/140 |
| 3,765,068 | 10/1973 | Rietjens | 28/268 X |
| 3,812,665 | 5/1974 | Holland | 57/34 B |
| 3,846,968 | 11/1974 | Sheehan et al. | 57/208 |
| 3,848,404 | 11/1974 | London, Jr. | 57/34 HS |
| 3,851,457 | 12/1974 | Waters | 57/208 |
| 4,010,523 | 3/1977 | Hense et al. | 28/72.11 |
| 4,070,815 | 1/1978 | Negishi et al. | 57/245 |
| 4,080,777 | 3/1978 | Griset | 57/140 J |
| 4,103,481 | 8/1978 | Vukoje | 57/208 |
| 4,152,886 | 5/1979 | Nelsono | 57/208 |
| 4,155,216 | 5/1979 | Griset | 57/295 |
| 4,160,359 | 7/1979 | Frentress | 57/409 |
| 4,219,998 | 9/1980 | Farnhill | 57/293 |
| 4,244,171 | 1/1981 | Sasaki et al. | 57/208 |
| 4,253,299 | 3/1981 | Borenstein et al. | 57/208 |
| 4,351,148 | 9/1982 | Eschenbach | 57/208 |
| 4,368,612 | 1/1983 | Eschenbach | 28/258 X |
| 4,467,594 | 8/1984 | Eschenbach | 57/208 |
| 4,489,542 | 12/1984 | Buzano et al. | 57/206 |
| 4,782,565 | 11/1988 | Sheehan et al. | 28/252 X |

FOREIGN PATENT DOCUMENTS

| | | | |
|---|---|---|---|
| 1294589 | 5/1969 | Fed. Rep. of Germany | 28/258 |
| 1451113 | 7/1966 | France | 28/252 |
| 53-43219 | 11/1978 | Japan | 28/252 |
| 1204676 | 9/1970 | United Kingdom | 28/258 |

OTHER PUBLICATIONS

Brochure, "Interlacing Jets", International Machinery Sales, Inc., Winston Salem, N.C., Apr. 1990.

Brochure, "Techtex® Bibliothèque", Techniservice, Kennett Square, Pa.

*Primary Examiner*—Werner H. Schroeder
*Assistant Examiner*—John J. Calvert
*Attorney, Agent, or Firm*—Edward J. Kaliski

[57] ABSTRACT

A novel yarn is a bundle of multifilament continuous supply yarns with two sequentially alternating lengths in a preselected ratio. The first length has alternating sections of entangled filaments and unentangled, crimped filaments alternating in closely, substantially randomly-variably spaced sequence. The second length has substantially unentangled, crimped filaments. The yarn has substantially uniform linear denier and the extent between nodes of the second length is greater than the extent between nodes of any of the second sections of the first length. The yarns made present a space dyed appearance, especially when multicolored supply yarns are employed, combined with varying textural effects. Apparatus for making the yarn has a source of crimped yarn, a transport for forwarding the supply yarn as a bundle, an entangling jet connected via a valve to pressurized fluid at a level to entangle yarn in the jet, programmed timed valve-sequencing to alternate the fluid supply to the jet between a yarn entangling condition and a nonentangling condition in a manner producing the novel yarn, and yarn overfeed transport and take-up means.

8 Claims, 4 Drawing Sheets

APPARATUS FOR MAKING NOVEL TEXTURED YARN

This invention is a division of application 07/462,654 filed Jan. 9, 1990, now U.S. Pat. No. 4,993,218.

FIELD OF THE INVENTION

This invention relates to the field of novelty, continuous filament yarns, the fabrics made from such yarns, and to the method and apparatus for producing such novelty yarns.

BACKGROUND OF THE INVENTION

The art is replete with yarns which when made into a fabric by weaving, knitting or the like produce an aesthetically pleasing difference in comparison with the product of linearly-uniform yarns.

The novelty-effecting difference stems from some form of linear variation in one or more properties. These include color (or dyeability), or texture or a combination of the two.

Texture variations have been produced by a multitude of means. For example, many forms of core and effect yarns are known. In these a backbone yarn is wrapped periodically by another yarn which by its bulk or entanglement or some other difference produces a discernible effect. Another broad class of novelty yarns is made by periodic variations in twist, usually false twist. Still another group is made by entanglement, interlacing, or bulking by means of fluid jet processing. It is this latter form with which the present invention is particularly related.

It should be noted here that interlacing is defined in U.S. Pat. No. 2,985,995, Bunting and Nelson.

In U.S. Pat. No. 4,489,542, Buzano et al. disclose a spun-like yarn with interlaced threads having alternately open, relatively bulky zones and closed, relatively compact zones. In the closed zones the fibers are interlaced and not bonded. The open zones have free strands more or less perpendicular to the bundle.

London Jr. et al., in U.S. Pat. No. Re. 31,808, teach a core and effect yarn processed by a jet showing a periodically varied pronounced difference in linear density. The variation preferably is pseudorandom. The jet is supplied with fluid alternately at spaced apart ports within the jet body located so that one port produces a loop in the effect yarn and the other port produces a spiraling motion. Separate valves are actuated by a numerical controller.

In U.S. Pat. No. Re. 31,376, Sheehan et al., there is disclosed a continuous yarn structure comprising periodically repeating lengths of high bulk, unentangled filaments alternating with lengths of compacted, entangled filaments.

Those familiar with the art will recognize that the above mentioned patents are but a few of the many teaching novelty yarn structures and associated methods and apparatus.

It is an object of the instant invention to provide a new and useful novelty yarn, process and apparatus.

It is a particular object to provide such a yarn which has linear variations in texture and bulk but which is characterized by substantially uniform linear density.

It is still a further object to provide such a yarn comprising at least two supply yarns of at least two colors and having alternating lengths; in which, in the first length, the colors are visually distinguished as a heather blend and in which, in the second length, the integrity of the colors is preserved to provide a combined yarn of a pleasing aesthetic appearance when made up into a fabric.

And yet a further object is to provide a combined yarn of a pleasing aesthetic appearance when made up into a fabric.

Still a further object is the provision of simple, effective apparatus to make such a novelty yarn.

STATEMENT OF INVENTION

The invention is a yarn and apparatus for making that yarn which comprises a bundle of multifilament continuous supply yarns with two sequentially alternating lengths in a preselected ratio of lengths; the first length comprising a series of two sequentially alternating sections; the first section comprising a node of substantially entangled crimped filaments; the second section comprising substantially unentangled crimped filaments; the sections alternating in closely, substantially randomly-variably spaced sequence with a preselected degree of randomness; the second length comprising substantially unentangled crimped filaments; and the yarn is characterized by substantially uniform linear denier and is further characterized in that the extent between nodes of the second length is greater than the extent between nodes of any of the second sections of the first length.

Fabrics, woven, knitted or tufted, comprising this yarn are included in the invention.

Novel apparatus is provided for making the novel yarn described above comprising: a source of crimped supply yarn; means for forwarding the supply yarn as a bundle: an entangling jet in fluid connection, including valving means, with a source of fluid under pressure at a level that entangles yarn passing through the jet upon delivery of the fluid to the jet; means for programmed, timed sequencing of the valving means between two conditions in a preselected ratio of time durations; the first condition enabling yarn entangling in the jet; the second condition not enabling yarn entangling in the jet; means for yarn overfeed transport; and yarn take-up means. A high pressure range entangles, the level controlling the alternation of first and second sections of the first length. A lower pressure range, or the total absence of fluid under pressure in the jet provides the non-entangling action. The time duration for the second condition is selected in the program so that the distance between nodes bounding the second length is greater than the distance between nodes of any of the second sections of the first length.

Preferably the source of crimped yarn is a creel mounted with at least two packages of uncrimped and undrawn yarn and yarn forwarding means that comprises at least two godet rolls that are adjustably driven and adjustably heated to comprise yarn drawing means feeding the yarn to stuffer-box crimping means sequentially located ahead of the yarn overfeed transport.

DETAILED DESCRIPTION OF THE DRAWINGS

Figure 1:
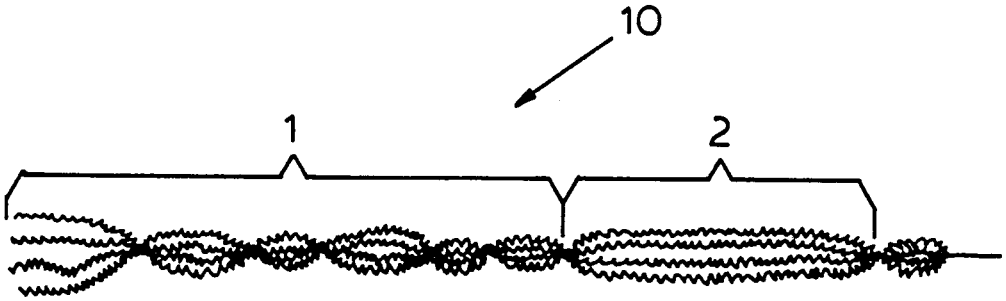
FIG. 1 is a schematic elevational view of a segment of a yarn according to the invention.

In FIG. 1 there is seen a segment 10 of the yarn of the invention. The yarn is a bundle of multifilament, crimped supply yarns of a continuous nature. It is made up of two sequentially alternating lengths 1 and 2. These lengths alternate in a preselected ratio of lengths.

The first length 1 comprises two sequentially alternating sections 3,4. In the first section 3, the yarn is substantially entangled in a node appearing on casual glance to form a knot of relatively short length. However, as is known, such entangled regions are not true knots, which require that an end be pulled through a loop, but are regions in which the filaments and short loops of filaments are displaced relative to each other both radially and axially and wrapped, entwined, crossed, and pulled into tight contact in a node where they are held by friction. This forms a node or tack point which cannot be returned to a substantially parallel condition. This type of entanglement, particularly that which is the product of entangling jets, is well known.

The second section 4 is a somewhat longer length of open unentangled filaments which retain their individual crimps.

The sections alternate in closely, substantially-randomly, variably-spaced sequence. This randomness is under substantial control as a function of the pressure of the fluid delivered to the entangling jet and is preselected to achieve the desired novelty aesthetics in the final product. Those familiar with the art will recognize that the higher the pressure delivered to any particular entangling jet the closer in distance will be the nodes formed, the degree depending on the jet as well as the yarn being processed.

Figure 2:
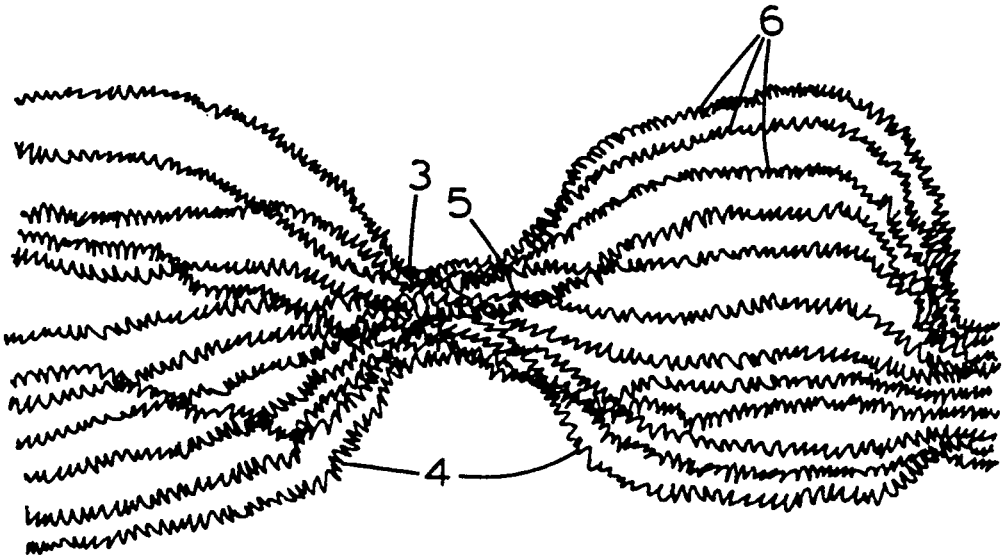
FIG. 2 is an enlarged view of a portion of FIG. 1.

The difference between the sections 3,4 is seen in FIG. 2 which is an enlarged view at a node 5 which is the highly entangled section 3 between two sections 4. For clarity only twelve filaments 6 are displayed. In practise many more may be present. For example, using four packages of 765/72 (765 denier with 72 continuous filaments), there would be 288. In section 3, the filaments 6 may or may not retain crimp depending on the local tension during entangling. In section 4, the filaments 6 retain their crimp. There, while there may be some crossing or rotation of position of the filaments 6, the bundle is substantially unentangled and is opened considerably.

The second length 2 is a still longer extent or distance between nodes, compared to any one of the sections 4 just described, of open, unentangled filaments which retain their crimped nature.

The lengths 1 and 2 alternate in sequence in a preselected ratio of lengths under control of the jet which is supplied with air in on and off pulses of controlled duration.

The alternating lengths are visually distinctive. If the supply yarns are of one color, the difference is subtle. Light reflecting from the different regions differently creates a slight difference both in shading and in brightness. There is also an appearance of a textural difference and a difference in bulk and these effects are randomly distributed along the length of the yarn.

When the supply yarns consist of different colors or shades of colors, the lengths differ in color contrast and both in seeming textural impression and in visual evaluation of bulkiness. In length 1, colors blend into a heather effect; in length 2, the integrity of the individual colors is maintained to yield a multicolored effect.

Figure 3:
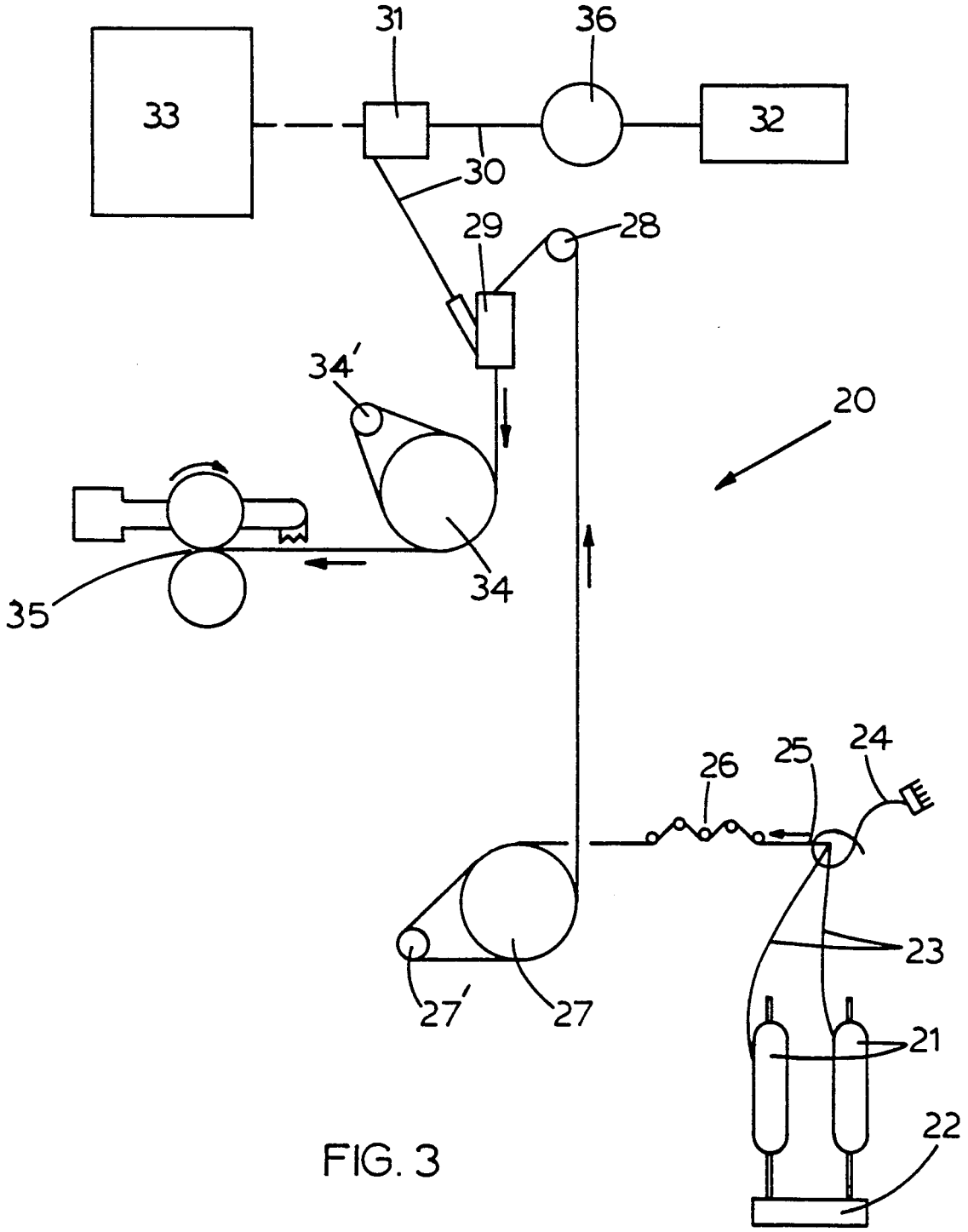
FIG. 3 is a schematic view of the apparatus of the invention.

Apparatus 20 for practising the invention is shown in FIG. 3. The description following combines both the structure, which is set forth generally in yarn stringup sequence, and operation.

Packages of crimped and drawn yarn 21 are mounted on creel 22. Means are provided for forwarding the supply yarn as a bundle. For example, ends 23 are combined in convergence guide 24 into yarn bundle 25 which passes through tensioner 26 to the godet roll 27 and its associated separator roll 27'. Yarn 25 then goes, guided by any needed guides such as roll 28, to jet 29. This is selected to be an entangling jet. Jet 29 is supplied with fluid under pressure, normally compressed air, through pipes 30 by way of valve 31 from supply 32. Pressure of the fluid delivered to valve 31 is selectively controlled by regulator 36. Valve 31, which may be a solenoid valve is controlled by device 33 which may be a manual switch but, more practically, is a programmable controller operating an electrical switch. In a preferred embodiment, valve 31 is a rotary valve driven by a stepping motor which is under the programmed control of a microcomputer.

After treatment in jet 29, the yarn bundle 25 proceeds via overfeed roll 34 with separator roll 34' to windup 35.

Figure 4:
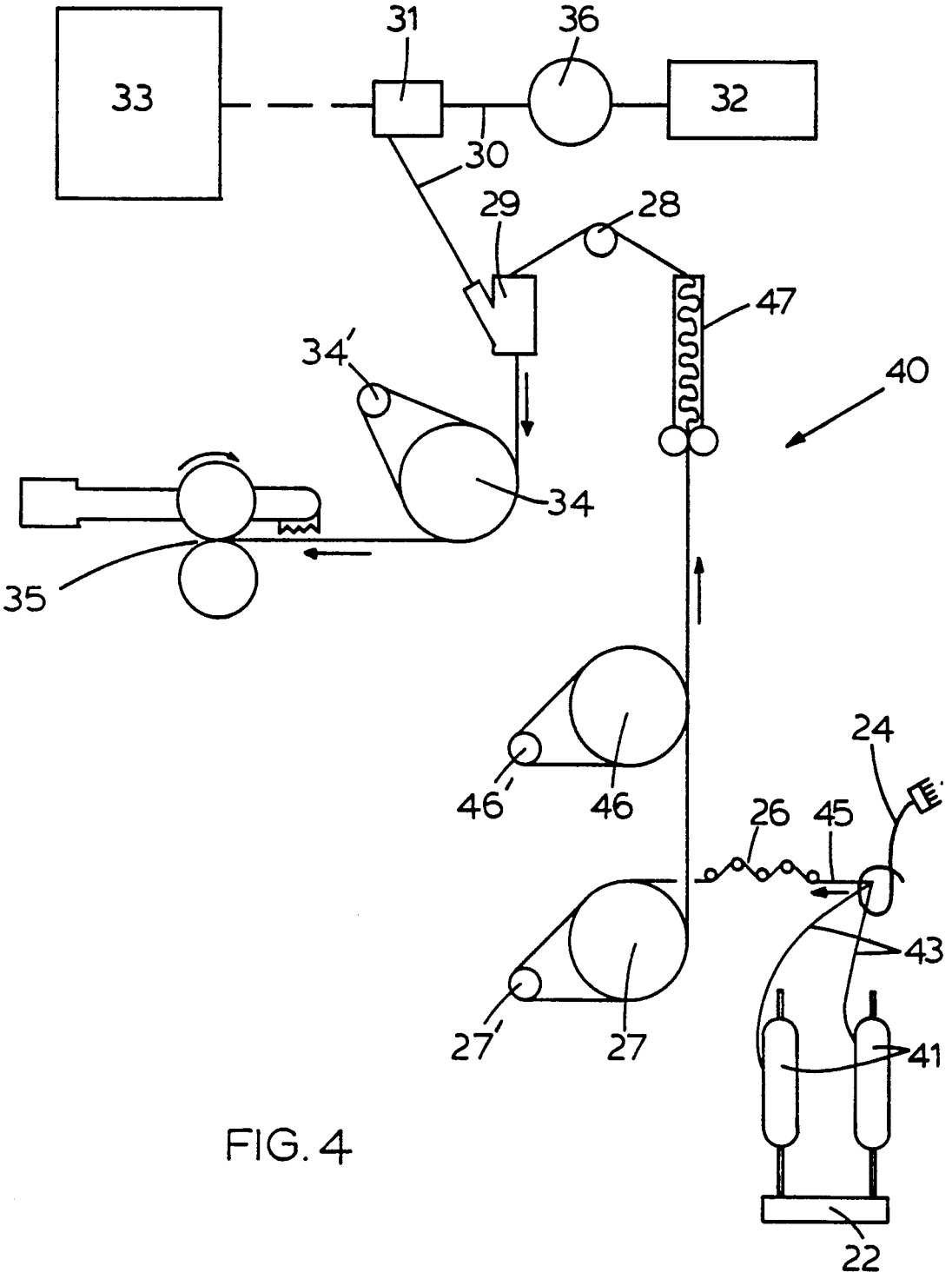
FIG. 4 is a schematic view of a preferred embodiment of the apparatus.

FIG. 4 shows a more preferred apparatus 40. Packages of undrawn, uncrimped yarn are placed on creel 22 and ends 43 are converged in guide 24 into yarn bundle 45. This is passed through tensioner 26 to heated, speed controlled godet rolls 27, 27', 46, 46' and drawn an appropriate amount as is known for any particular starting yarn. In stuffing box crimper 47, yarn bundle 45 is crimped. While the stuffing box type of crimper is preferred, other types may be substituted. The yarn passage downstream of the crimper 47 is the same as that described for FIG. 3. Both apparatus arrangements produce the yarn of the invention.

Figure 5:
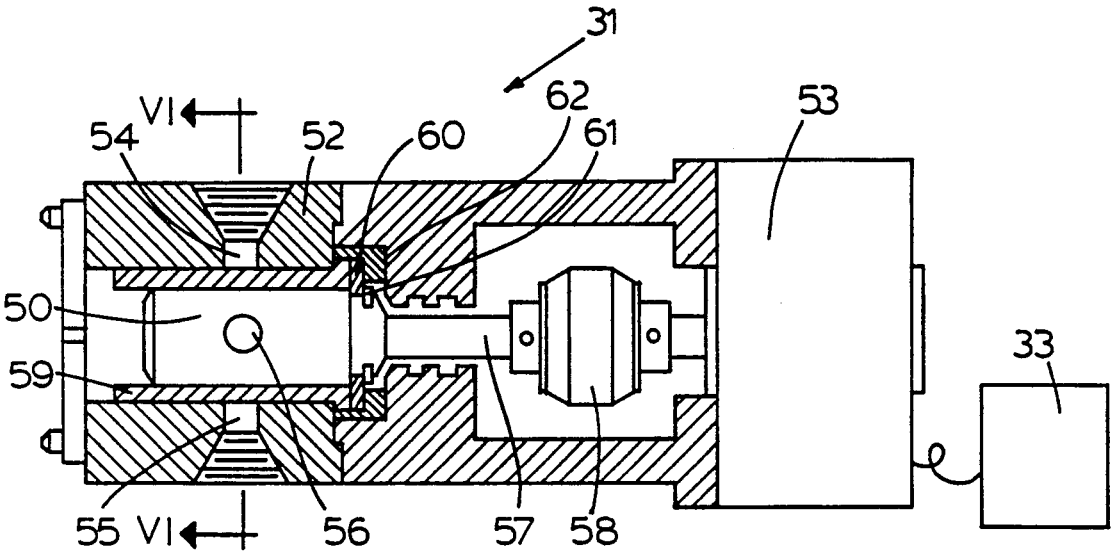
FIG. 5 is a somewhat schematic cross-section of a valve useful in the apparatus of the invention.

A particularly useful, controllable valve 31 is shown in FIG. 5. In essence it comprises a rotor 50 in a ported housing 52 in rotational connection with a stepping motor 53 which is actuated by control device 33. Randomness or pseudo-randomness in the ratio of lengths 1 and 2 can be imposed on the stepping motor/valve assembly by programmable control device 33. Because the ports are covered and uncovered progressively, a fine scale difference at transitions may occur depending on speed of operation and compared to a solenoid valve. The effect of this difference on overall appearance of the yarn is minimal.

Figure 6:
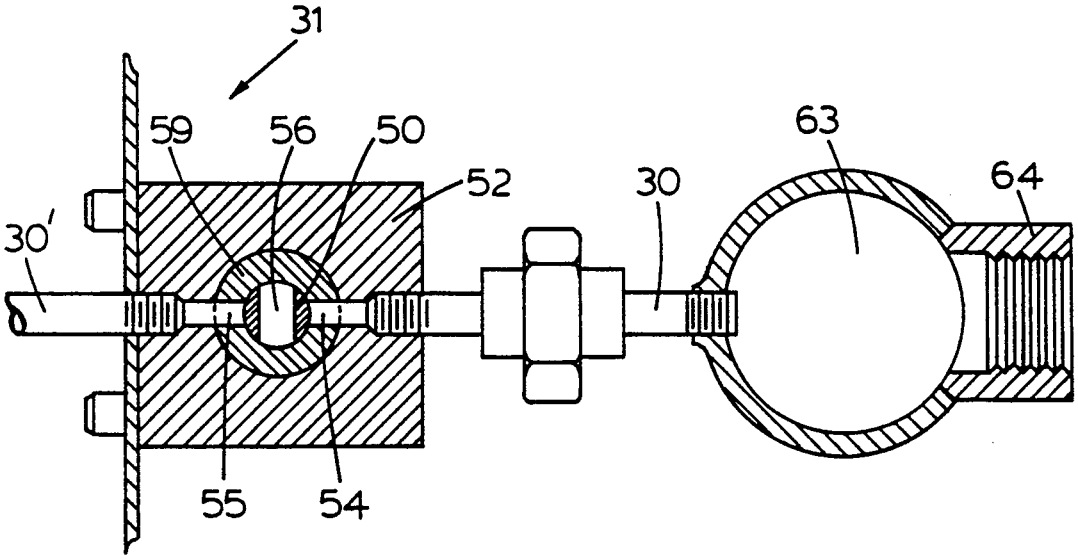
FIG. 6 is a cross-section of the valve of FIG. 5 taken on the line VI—VI and further shows an associated fluid plenum.

FIG. 6 shows a cross-section through the valve 31 of FIG. 5 and illustrates the connections preferred for fluid flow.

A plenum 63 for air, the fluid of choice, is connected by piping 30 to valve 31. Plenum 63 may be a vessel of any volume providing it is large enough to damp out pulsations from a compressor or like source of compressed air not shown. In the figure, plenum 63 is a large diameter pipe of sufficient length capped at both ends to form a tank. Only the cross-section is shown. It is connected through pipe 30' to jet 29 and is ported for fluid supply by fitting 64 which is connected by pipes 30 to a source of fluid under pressure by way of pressure regulator 36 (see FIGS. 2 and 3). Pipe 30' connects valve 31 to jet 29 (not shown in FIG. 6).

In operation ports 54, 55 are connected by the through-hole 56 in rotor 50, part of shaft 57, which is in rotational connection by coupling 58 with motor 53, preferably a stepping motor. Flanged bearing 59, a porous bronze bearing, provides lubricated support. Steel washer 60 held by lockring 61 and porous bronze thrust bearing 62 locate the assembly and accommodate thrust. Air is maintained under a preselected pressure in plenum 63. A signal from controller 33, according to a preselected program, actuates stepping motor 53 to rotate rotor 50 through 90 degrees so that through-hole 56 aligns with ports 54, 55 and air flows to jet 29. After a preselected time interval, stepping motor 53 is reactivated to return rotor 50 to the initial position to cut off fluid flow.

It should be apparent to those familiar with the art that more than one jet can be controlled by a single valve 31 by providing parallel porting and matching through-holes in rotor 50 of a suitable length.

Control device 33 may be any type of adjustable timing device controlling input to motor 53, a microcomputer may be used. We prefer a programmable controller.

Surprisingly, despite the obvious great disparity in the appearance of the two lengths and the two sections of length 1, the density of the two lengths is substantially uniform. This has been established in the examples which follow:

A TECHTEX draw-crimp-entangling machine (available from Techniservice, PO Box P, Kennett Square, PA 19348) was used. The draw zone had two 4 inch diameter induction heated godet rolls set to provide 3.0 to 1.0 draw ratio. The machine was equipped with a stuffer box crimper using mechanical infeed rolls and supplied the crimped yarn to an entangling jet. Forwarding rolls (let down rolls) reduced the resultant tension and passed the processed yarn to a surface driven windup. The supply yarn was 765 denier undrawn polypropylene (PP) fiber having 72 filaments. The supply packages used in the trials were 1 to 4 different colored ends. A variety of trials were run.

The packages were mounted on the creel and the ends were processed together, draw-crimped and passed through the entangling jet. The jet was a "2—2" stepped entangling jet available from IMS, Winston-Salem, NC. The compressed air supply to the jet of 80 pounds per square inch guage was pulsed in an on-off rapid cycling action. For these trials, a solenoid valve was inserted between the jet and the source of compressed air. An electrical switch actuating the solenoid was manually pulsed in a rhythmic manner to produce the novelty yarn of the invention. The more contrasted the colored input ends were, the greater the visual distinction between the different alternating lengths. The less contrasted the ends, as in the case of the same color, the less the distinctive visual difference. Using multicolored supply yarns, in the first length the yarns formed a heather blend type of appearance in which the colors of the individual suppy yarns were substantially not distinguishable. In the second length, the individual color integrity was maintained and was distinguishable. Overall, the yarn was not of uniform appearance along its length but may be said to have had a space dye type of appearance especially where contrasting colors were used. A subtle, variegated appearance was achieved when similar colors or muted colors of the same family were used.

With the particular apparatus array and the yarn above, it was found that yarn according to the invention was made with air pressures between 40 and 80 psi, the pressure level controlling the frequency of nodes in the first length as described above. The higher pressure is preferred.

Knitted into fabrics in a tubular sock knitting machine, novel fabrics were produced characterized by the color shadings and contrasts as though they were made of fabrics made from space dyed yarns. This color effect was combined with pleasing textural variations. The effects were variably controllable depending on the jet air supply pressure level which varied the randomness of the nodes 5 in lengths 1. The ratio of lengths 2 to 1 was controlled by the variations in the on-off ratio programmed in operating valve 31.

Visually the highly entangled yarn was darker and brighter than the unentangled yarn. It is plain that similar results would be attained by weaving or tufting with these yarns.

Two of the trials were run to evaluate the relative nature of the two successive lengths. Two skeins of a solid color were processed under the same conditions as above except that one was highly entangled, produced by maintaining the air supply to the jet at full 80 psi pressure without programming any off-time. The other skein was substantially unentangled, produced by shutting down the air supply to the jet. A skein of 90 meters of the entangled yarn weighed 6.977 grams (698 denier). A skein of 90 meters of the unentangled yarn weighed 7.095 grams (710 denier). The difference is within 2 percent. We believe this result shows that the along-the-line denier of the yarn with alternating lengths of the two types is substantially uniform and believe this result stems from the use of crimped yarn.

What is claimed is:

1. Apparatus to make a novelty yarn useful in knitted, woven, and tufted fabrics comprising:

a) a source of crimped supply yarn:

b) means for forwarding the supply yarn as a bundle;

c) an entangling jet in fluid connection, including valving means, with a source of fluid under pressure at a level that entangles yarn passing therethrough into nodes;

d) means for programmed timed sequencing of the valving means between two conditions in a preselected ratio of time durations;

e) a first condition enabling yarn entangling in the jet into the nodes of substantially entangled crimped filaments alternating with sections of substantially unentangled crimped filaments, the nodes and the sections of substantially unentangled yarns alternating in closely, substantially randomly variably spaced sequence;

f) a second condition not enabling yarn entangling in the jet and the time duration of an second condition is such that the extent between the nodes bounding the unentangled yarn thereby produced is greater than an extent between any of the nodes bounding the unentangled yarn produced during the first condition;

g) means for yarn overfeed transport; and h) yarn take-up means.

2. The apparatus of claim 1 wherein the source of crimped yarn is a creel and at least one package thereon is of precrimped and predrawn yarn.

3. The apparatus of claim 2 wherein the valving means is a rotary valve.

4. The apparatus of claim 3 wherein the rotary valve is actuated by a motor.

5. The apparatus of claim 1 wherein the source of crimped yarn is a creel and at least one package thereon is of uncrimped and undrawn yarn and wherein the yarn forwarding means comprises at least two godet rolls and the apparatus further comprises stuffer-box crimping means sequentially located between elements b) and c) of claim 1 and the godet rolls are adjustably driven and adjustably heated to comprise yarn drawing means.

6. The apparatus of claim 5 wherein the valving means is a rotary valve.

7. The apparatus of claim 6 wherein the rotary valve is actuated by a motor.

8. The apparatus of claim 1 wherein the valving means is a rotary valve actuated by a stepping motor and the programmed timed sequencing means is a microcomputer or programmable controller preprogrammed to sequence the valving means between said two conditions in a preselected ratio of time durations.

* * * * *